US006343563B1

(12) United States Patent
Dirlik et al.

(10) Patent No.: US 6,343,563 B1
(45) Date of Patent: Feb. 5, 2002

(54) MODULAR BULWARK DECK SHIELDING CONSTRUCTION AND ASSEMBLAGE

(75) Inventors: Steven P. Dirlik, Silver Spring; Richard Bruce Potemken, North Potomac, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/703,683

(22) Filed: Nov. 2, 2000

(51) Int. Cl.[7] ..... B63B 17/00
(52) U.S. Cl. ..... 114/364; 114/343
(58) Field of Search ..... 114/343, 364

(56) References Cited

U.S. PATENT DOCUMENTS

| | | | | |
|---|---|---|---|---|
| 2,817,859 A | * | 12/1957 | McCarthy, Jr. | 114/361 |
| 3,807,338 A | * | 4/1974 | Shader | 114/283 |
| 4,856,450 A | * | 8/1989 | Lubahn | 114/293 |
| 5,970,899 A | | 10/1999 | Michaelson et al. | |

* cited by examiner

*Primary Examiner*—Jesus D. Sotelo
(74) *Attorney, Agent, or Firm*—Jacob Shuster

(57) ABSTRACT

Single panels are supported exclusively on the uppermost and lowermost of a plurality of life rails extending between stanchions on the topside deck surface of a ship. The panels are attached to the rails by clamps which are releasable for detachment of the panels to accommodate slidable insertion and pivotal displacement by personnel for installation or replacement in shielding positions between the stanchions.

9 Claims, 2 Drawing Sheets

MODULAR BULWARK DECK SHIELDING CONSTRUCTION AND ASSEMBLAGE

The present invention relates in general to protective shielding of deck surfaces of ships during seagoing travel.

BACKGROUND OF THE INVENTION

Protective shielding of ship deck surfaces for various purposes, including reduced radar detection for naval surface vessels as well as protection against wind and salt spray to reduce corrosion and maintenance costs, are goals and requirements heretofore dealt with at relatively high costs and with increase in topside marine vessel weight, involving for example permanent steel structures on topside deck surfaces, and structural shaping and material treatments of shielding facilities. Such shielding problem solutions were not only costly and added to topside weight but required continuous inspection and maintenance to remain effective. It is accordingly an important object of the present invention to provide less costly shielding protection for marine vessel topside deck surfaces, capable of being more readily maintained effectively without excessive weight increase of the topside deck.

SUMMARY OF THE INVENTION

In accordance with the present invention, modular bulwarks are installed in shielding positions between stanchions ordinarily mounted on a topside deck surface of a ship, by support exclusively on the uppermost and lowermost of the plural life rails heretofore extending between the stanchions. Each of such modular bulwarks is formed by a single panel of standardized shape and size having an outer surface aligned with the stanchions and an inner surface to which assembled clamps are attached for installation and replacement of the panels by personnel standing on the topside deck surface while the ship is underway during seagoing travel. Each clamp includes a base element attached to the inner surface of the panel, having an arcuate recess within which one of the life rails is seated. An outer clamp element is interconnected with the base element by a threaded bolt fastener about which the outer element is pivotally displaced over the base element between an unclamped position and a clamped position engaging the rail seated within both clamp elements. Installation or replacement of the panel as aforementioned is effected by insertion thereof between the rails and pivotal displacement relative thereto, followed by tightening of the threaded bolt fasteners by means of wingnuts associated therewith, which also accommodates selective unclamping for panel replacement purposes.

DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
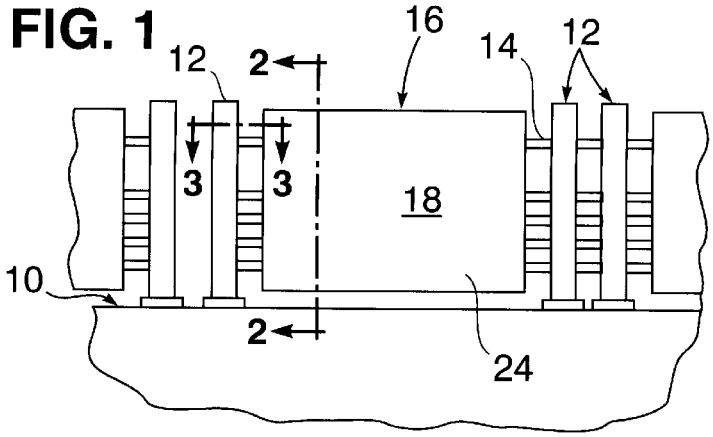
FIG. 1 is a partial side elevation view of a ship topside deck with modular bulwark shielding in accordance with one embodiment of the present invention.

Referring now to the drawing in detail, FIG. 1 depicts a portion of a topside deck 10 of a marine vessel, on which a plurality of vertical stanchions 12 are fixedly mounted in spaced relation to each other for supporting of therebetween vertically spaced horizontal life rails 14. The topside surface of the deck 10 is thereby shielded, pursuant to the present invention, by a series of modular bulwarks 16 assembled on and attached to the rails 14 between the stanchions 12. Each of such modular bulwarks 16 comprises a single rectangular panel 18 made of a composite lightweight material and dimensioned to a standardized size and shape so as to accommodate mass production and to fit between the stanchions 12 as illustrated in FIG. 1.

Figure 2:
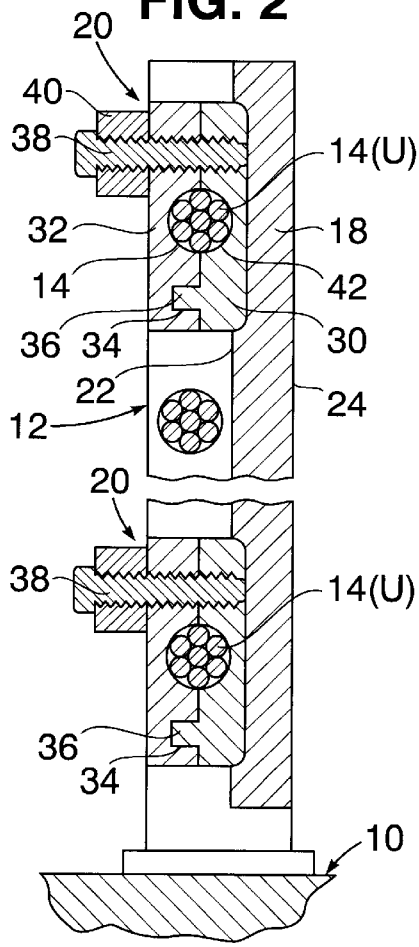
FIG. 2 is an enlarged partial section view taken substantially through a plane indicated by section line 2—2 in FIG. 1.
Figure 3:
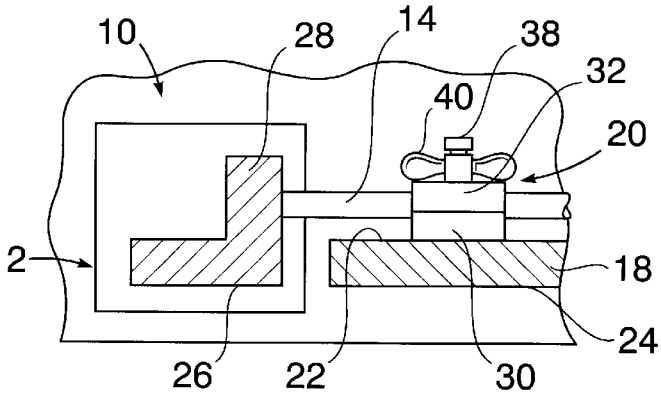
FIG. 3 is an enlarged partial section view taken substantially through a plane indicated by section line 3—3 in FIG. 1.
Figure 4:
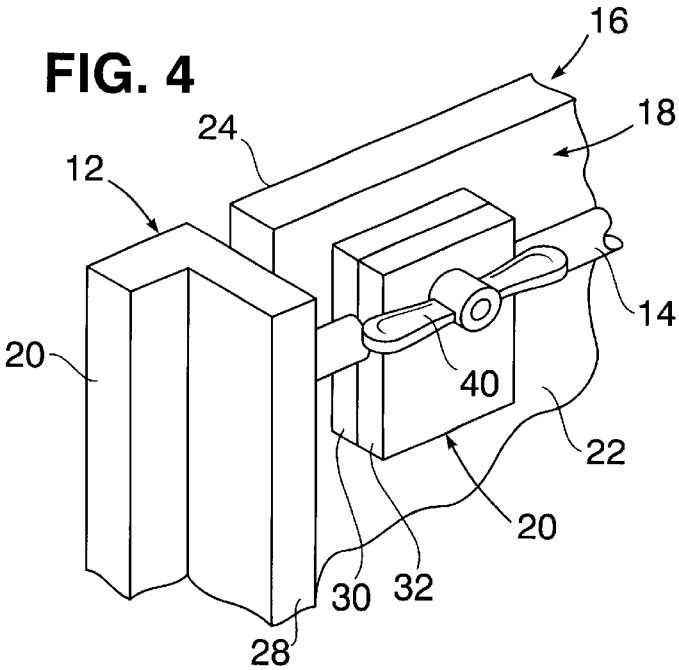
FIG. 4 is a partial perspective view of the modular bulwark shielding shown in FIG. 1.

FIGS. 2, 3 and 4 illustrate assemblage of the panels 18 on the rails 14 by assembled clamps 20 mounted on and projecting from an inner vertical surface 22 of each panel 18. Such clamps 20 are attached to the panel surface 22 in alignment with the uppermost and lowermost of the rails 14 for support of the panels with their outer panel surfaces 24 in alignment with the outer surfaces of the leg portions 26 of the stanchions 12 and at right angles to the confronting surfaces of the stanchion leg portions 28 to which the rails 14 are connected.

Each clamp 20 includes a rectangular base element 30 attached to the inner surface 22 of a panel 18 and an outer matching element 32 having a hole 34 formed therein receiving a retention pin 36 projecting from the base element 30, closely spaced below the rails 14 in the assembled condition of the clamp 20 as shown in FIG. 2. A threaded bolt fastener 38 associated with each clamp 20 extends through the assembled clamp elements 30 and 32 vertically spaced above the uppermost rail 14(*u*) or the lowermost rail 14(*l*). A wing nut 40 is threadedly positioned on the bolt fastener 38 in abutment with the outer clamp element 32 to hold it clamped to the base element 30 and a rail 14 seated within arcuate recesses 42 and 44 respectively formed in the clamp elements 30 and 32. Thus, the clamps 20 may be selectively assembled and clamped to the uppermost and lowermost of the rails 14 to hold the panels 18 in the shielding positions as shown in FIGS. 1–4. Each clamp 20 is initially assembled as shown in FIG. 5, with the outer clamp element 32 pivotally positioned by its bolt fastener 38 on an associated base element 30 in an unclamped position disengaged from the retention pin 36.

Figure 5:
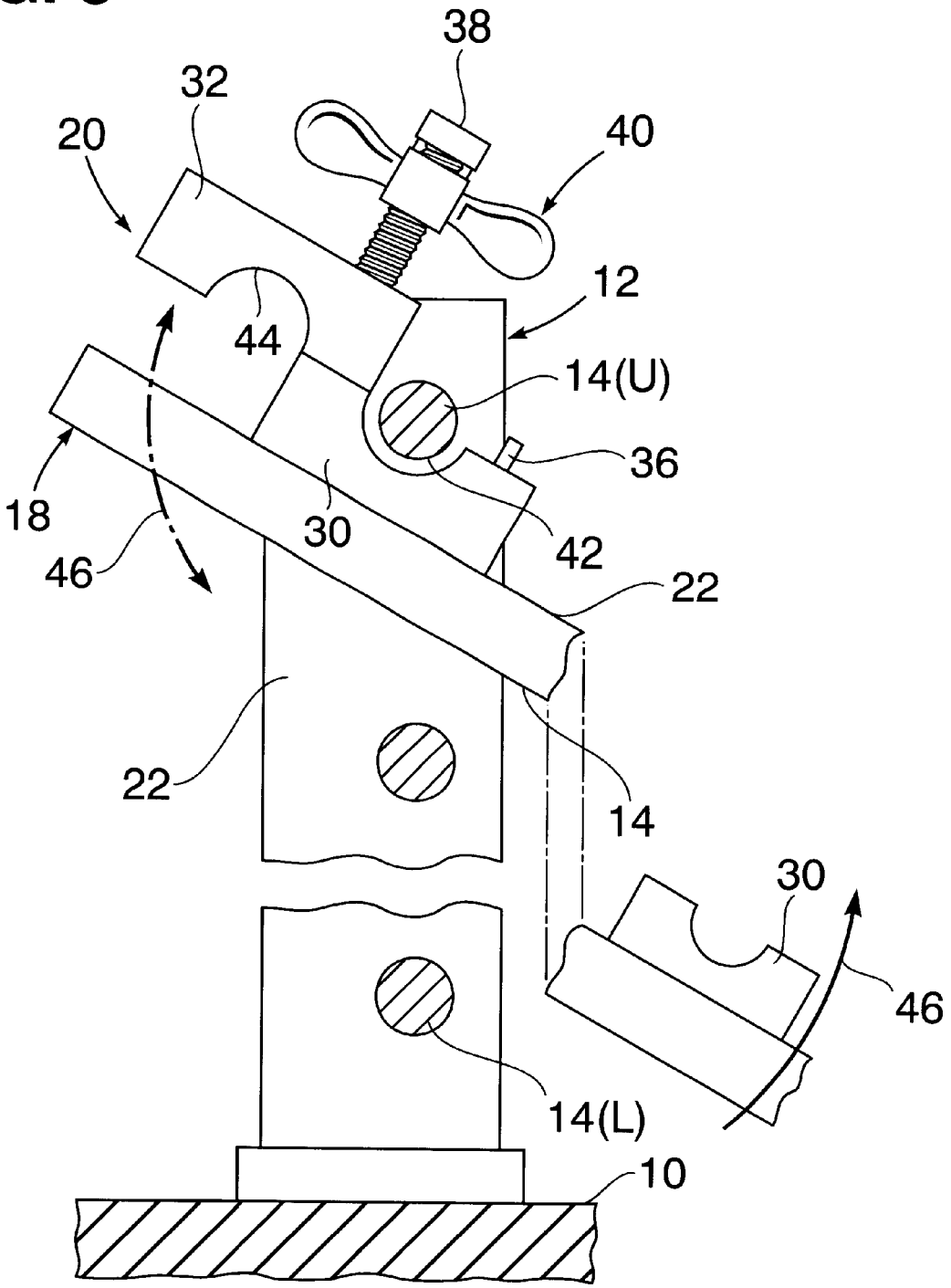
FIG. 5 is a partial side section view of the modular bulwark shielding of FIGS. 1–4 being assembled.

With continued reference to FIG. 5, the installation procedure for each panel 18 is initiated by initial assembly of the top rail clamps 20 on the panel 18 with their clamp elements 32 in the aforementioned unclamped positions. The top of the panel 18 is then slid upwardly between the top two life rails 14, as shown in FIG. 5, until the arcuate recesses 42 in the base clamp elements 30 are aligned below with the uppermost rail 14(*u*). The top clamps 20 in such unclamped conditions will then be facing inwardly from the inner surface 22 of the tilted panel 18 so as to accommodate continued manual manipulation thereof by personnel standing on the surface of the deck 10. The panel 18 may thereby be maneuvered so as to seat the top rail 14(*u*) within the recesses 42 and 44 of the top clamps 20, followed by pivotal displacement in an on-board angular direction as indicated by arrow 46 to bring the bottom clamps 20 into seating engagement with the lowermost rail 14(*l*) before all of the top and bottom clamps 20 are placed in clamped condition by manual tightening of the wingnuts 40. Such wingnuts 40 also enable loosening of the clamps 20 and pivotal displacement of their outer elements 32 to the unclamped positions for removal and replacement of the panels 18.

It will be apparent from the foregoing description that effective deck surface shielding is provided for by the panels 18 of the modular bulwarks 16 on the life rails 14 of an existing type of marine vessel deck 10, without major shipyard tasking, since such modular bulwarks 16 because of the described installation procedure may be installed or removed while the marine vessel is underway so as to enable easy panel replacement under seagoing travel conditions. All of the advantages of permanent radar cross section shielding and barrier protection from wind and salt spray are thereby also afforded at a lower cost, with less topside weight and without loss of operational flexibility.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a surface deck of a marine vessel having topside stanchions mounted thereon and a plurality horizontally spaced rails extending between the stanchions, surface shielding means supported on said rails between the stanchions, comprising: modular bulwarks respectively disposed between the stanchions; and clamp means mounted on each of the modular bulwarks for attachment thereof exclusively to uppermost and lowermost of the rails between the stanchions to accommodate installation of the modular bulwarks by personnel on the surface deck of the marine vessel during seagoing travel.

2. The combination as defined in claim 1, wherein each of said modular bulwarks includes: a single panel of standardized shape and size having an outer surface aligned with the stanchions and an inner surface attached to the uppermost and the lowermost of the rails by the clamp means.

3. The combination as defined in claim 2, wherein said clamp means is attached to the inner surface of each of the panels of the modular bulwarks in alignment with the uppermost and the lowermost of the rails to which said clamp means is removably clamped.

4. The combination as defined in claim 3, wherein said clamp means includes: a base element fixed to the inner panel surface within which one of the rails is seated; an outer element; and threaded bolt fastener means interconnecting the base and outer elements for pivotal displacement of the outer element between an unclamped position and a clamped position engaging said one of the rails seated in the base element, whereby installation of the modular bulwark is accommodated by insertion between the rails and pivotal movement relative thereto.

5. The combination as defined in claim 1, wherein said clamp means is attached to the modular bulwarks in alignment with the uppermost and the lowermost of the rails to which the clamp means is removably clamped.

6. The combination as defined in claim 5, wherein said clamp means includes: a base element, an outer element; and threaded bolt fastener means interconnecting the base and outer elements for pivotal displacement of the outer element between an unclamped position and a clamped position engaging said one of the uppermost or the lowermost of the rails seated in the base element, whereby installation of the modular bulwark is accommodated by insertion between the rails and pivotal movement relative thereto.

7. In combination with a surface deck of a marine vessel having topside stanchions mounted thereon and a plurality horizontally spaced rails extending between the stanchions, surface shielding means supported by said rails between the stanchions, comprising: single panels respectively disposed between the stanchions; and clamp means mounted on each of the panels for attachment thereof exclusively to uppermost and lowermost of the rails between the stanchions to accommodate installation by personnel on the surface deck of the marine vessel during seagoing travel.

8. The combination as defined in claim 7, wherein said clamp means includes: a base element fixed to one of the panels and within which one of the rails is seated; an outer element; and bolt fastener means interconnecting the base and outer elements for pivotal displacement of the outer element between an unclamped position and a clamped position engaging said one of the rails seated in the base element, whereby installation of the panel is accommodated by insertion between the rails and pivotal movement relative thereto.

9. The combination as defined in claim 8, wherein said clamp means further includes: means threadedly mounted on the bolt fastener means for selectively tightening the outer element in the clamped position to hold said one of the rails seated in the base element.

* * * * *